US005189767A

United States Patent [19]

Reitsma

[11] Patent Number: 5,189,767

[45] Date of Patent: Mar. 2, 1993

[54] CLOSURE DEVICE SECURITY COVER

[76] Inventor: Klaas Reitsma, #20 - 18812 - 96th Avenue, Surrey, B.C., Canada, V3T 4W2

[21] Appl. No.: 794,419

[22] Filed: Nov. 19, 1991

[51] Int. Cl.[5] ..... A44B 11/26

[52] U.S. Cl. ..... 24/633; 24/573.1

[58] Field of Search ..... 24/573.1, 633, 459, 24/636–642

[56] References Cited

U.S. PATENT DOCUMENTS 4,612,680 9/1986 Daiguji ..... 24/459 X 4,674,303 6/1987 Salcone, II ..... 24/633 X

FOREIGN PATENT DOCUMENTS

WO84/01275 4/1984 PCT Int'l Appl. ..... 24/633

*Primary Examiner*—James R. Brittain

*Attorney, Agent, or Firm*—William H. Pavitt, Jr.; Daniel L. Dawes; Mario A. Martella

[57] ABSTRACT

A cover for securing about an engaged closure device comprising a body having an upper portion and a lower portion that define a cavity therebetween to accept and enclose the closure device. A locking system of flanges engageable in slots is provided to releasably secure the upper and lower portions together to prevent access to the closure device thereby preventing accidental or unauthorized opening of the engaged closure.

7 Claims, 1 Drawing Sheet

CLOSURE DEVICE SECURITY COVER

FIELD OF THE INVENTION

This invention relates to a security cover for securing about an engaged closure device, such as a seat belt or the like, to ensure that accidental or unauthorized opening of the engaged closure device does not occur.

BACKGROUND OF THE INVENTION

Seat belt use in vehicles is generally recognized as the best way to prevent or lessen serious injury in the event of an accident. Seat belt use is now mandatory in many countries.

Proper seat belt use by children is a definite concern of many parents. It is not uncommon for younger children to play with their seat belt buckle and inadvertently or intentionally release their seat belt. Most seat belts are designed for quick and easy release by pressing a single button, making it possible for even a young child to release the protective seat belt. It is often impractical for the parents to keep an eye on their children while in the car to ensure that seat belts are properly worn at all times.

Accordingly, there is a need for a safety device that can be applied to a child's seat belt closure buckle to prevent accidental or unauthorized opening of the closure and ensure that a child remains safely belted at all times. An important feature of such a device is that it be simple and efficient for an adult to apply and remove and be completely child-proof.

SUMMARY OF THE INVENTION

The present invention provides a safety device that addresse the foregoing problems.

Accordingly, the present invention provides a cover for securing about an engaged closure device comprising:

a body having an upper portion and a lower portion that define a cavity therebetween to accept and enclose the closure device; and locking means to releasably secure the upper and lower portions together to prevent access to the closure device thereby preventing accidental or unauthorized opening of the engaged closure.

BRIEF DESCRIPTION OF THE DRAWINGS

Aspects of the present invention are illustrated, merely by way of example, in the accompanying drawings, in which.

DESCRIPTION OF THE PREFERRED EMBODIMENTS

Figure 1:
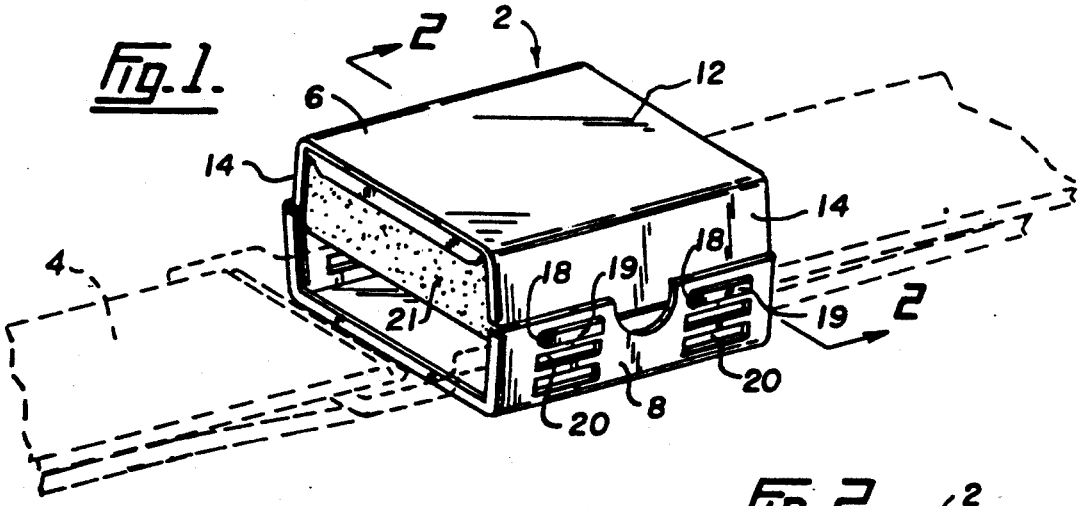
FIG. 1 is a pictorial view of an embodiment of the present invention in place about an engaged seat belt buckle shown in dashed lines.

FIG. 1 shows a preferred embodiment of the cover 2 of the present invention in place over a closure device in the form of a seat belt buckle and strap 4 shown in dashed lines.

Figure 3:
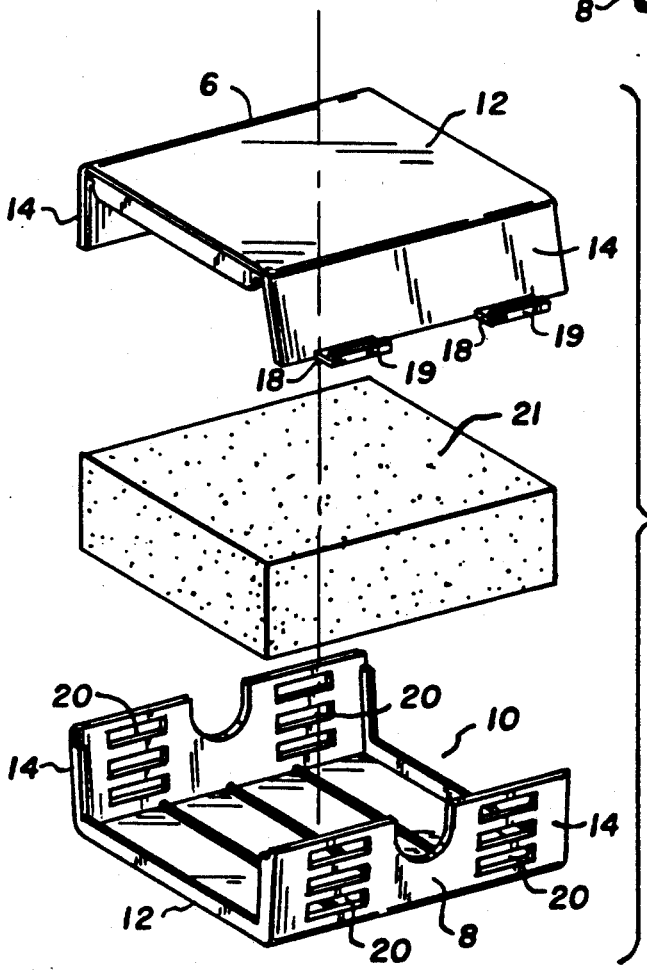
FIG. 3 is an exploded view of cover of the present invention showing component parts.

As best shown in FIG. 3, cover 2 comprises a body having an upper portion 6 and a lower portion 8 that define a cavity 10 therebetween to accept and enclose the seat belt buckle. Both portions have an essentially C-shaped cross-sectional configuration formed from a planar surface 12 with a pair of depending sidewalls 14. Portions 6 and 8 are moulded from a flexible plastic. It will be appreciated that in the illustrated embodiment, the portions are separate, however, it is also possible to join the two portions together using a flexible connecting piece.

Depending sidewalls 14 are formed with interlocking means to releasably secure the upper and lower portions together over the seat belt buckle to prevent access to the closure device thereby preventing accidental or unauthorized opening of the engaged closure by children. The interlocking means are designed to difficult for a young child to manipulate. The depending sidewalls of upper portion 6 are formed with outwardly extending flanges 18 that each terminate in an upturned lip 19. The sidewalls of lower portion 8 are formed with a series of slots 20 dimensioned to accept flanges 18 and upturned lips 19. In addition, biasing means in the form of a resiliently deformable member 21 is mounted to the upper or lower body and extends into cavity 10 for contact with the seat belt buckle.

Figure 2:
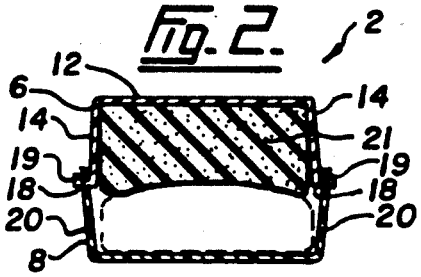
FIG. 2 is section view taken along line 2—2 of FIG. 1.

In use, lower portion 8 is positioned below an engaged seat belt buckle such that the buckle sits within cavity 10 between the sidewalls 14. Upper portion 6 is then positioned in opposed relationship over lower portion 8. Manual pressure is applied against the side walls 14 of upper portion 6 to slightly deform the sidewalls inwardly to interfit between the sidewalls of lower portion 8. Downward pressure is also necessary to compress member 21 against the seat belt buckle. Flanges 18 are aligned with a set of slots 20 and pressure is released causing the upper sidewalls to return to their normal position. This results in flanges 18 and lips 19 passing through slots 20 to the outer surface of the lower side walls to secure the two portions together about the closure device. This secured position is best shown in FIG. 2 and access to the seat belt buckle release button is prevented. Resiliently deformable member 21 ensures that there is a biasing force tending to separate the upper and lower portions so lips 19 are biased out of alignment with slots 20 to engage the outer surface of the lower sidewalls to lock the two portions together.

Due to the presence of lips 19 and the compressible member, separating the upper portion from the lower portion requires both a downward force and an inward pressure to align the lips with slots 20 and deform the upper sidewalls to permit the flanges to slide through slots 20 for release of the upper portion. Such a downward and inward force is easy for an adult to master whereas a young child will generally not have the strength or co-ordination to push and squeeze at the same time. Therefore, the device of the present invention is rendered child-proof.

In the event of an emergency, the device of the present invention can be easily torn away by an adult or older child not familiar with the device and intent on removing a younger child from the car. In this regard, the device of the present invention is preferably manufactured from a plastic that is readily breakable if sufficient force is applied. Flanges 18 provide sites for breakage if sufficient force is applied.

It is also a feature of the present invention that a series of slots 20 can be formed in lower portion 8 to accommodate various sizes of seat belt buckles.

Although the present invention has been described in some detail by way of example for purposes of clarity and understanding, it will be apparent that certain changes and modifications may be practised within the scope of the appended claims.

I claim:

1. A cover for securing about an engaged closure device comprising:

a body having an upper portion and a lower portion that define a cavity therebetween to accept and enclose the closure device, said upper and lower portions having depending sidewalls that are positionable in opposed relationship such that the depending sidewalls of one portion are deformable to interfit between the depending sidewalls of the other portion; and interlocking means comprising slots formed in the depending sidewalls of one portion of the body and projecting flanges formed in the depending sidewalls of the other portion dimensioned to be insertable through the slots, and biasing means tending to bias apart the upper and lower portions to ensure that release of the flanges from the slots must be accomplished by a compressive force to overcome the force necessary to remove the flanges from the the force necessary to remove the flanges from eh slots, whereby the interlocking means act to releasably secure the upper and lower portions together to prevent access to the closure device thereby preventing accidental or unauthorized opening of the engaged closure device.

2. A cover as claimed in claim 1 in which said body comprises separate upper and lower portions.

3. A cover as claimed i claim 1 in which the projecting flanges have terminal raised lips dimensioned to be insertable through the slots, and the biasing means tend to bias apart the upper and lower portions to ensure misalignment of the raised lips with the slots once the flanges are inserted in the slots such that release of the flanges form he slots must be accomplished by a compressive force to overcome the force of the biasing means.

4. A cover as claimed in claim 1 in which said biasing means comprises a resiliently deformable member mounted to the upper or lower portion and extending into the cavity for engagement with the closure device.

5. A cover as claimed n claim 1 in which said upper and lower portions have an essentially C-shaped cross-sectional configuration.

6. A cover as claimed in claim 1 formed with a plurality of slots in which to engage each flange to permit adjustment of the fit about a closure device.

7. A cover as claimed in claim 1 in which the body is formed form a flexible plastic.

* * * * *